US008243976B2

(12) United States Patent
Giese et al.

(10) Patent No.: US 8,243,976 B2
(45) Date of Patent: Aug. 14, 2012

(54) EARPHONE FACILITY WITH VIBRATION-ISOLATED EARPHONE

(75) Inventors: Ulrich Giese, Erlangen (DE); Maja Serman, Erlangen-Buckenhof (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 502 days.

(21) Appl. No.: 12/577,290

(22) Filed: Oct. 12, 2009

(65) Prior Publication Data

US 2010/0098286 A1 Apr. 22, 2010

(30) Foreign Application Priority Data

Oct. 22, 2008 (DE) ..... 10 2008 052 683

(51) Int. Cl.
*H04R 25/00* (2006.01)

(52) U.S. Cl. ..... 381/380; 381/328

(58) Field of Classification Search ..... 381/312, 381/322, 328–330, 380–382; 181/130, 135
See application file for complete search history.

(56) References Cited

U.S. PATENT DOCUMENTS 5,694,475 A * 12/1997 Boyden ..... 381/327
5,701,348 A * 12/1997 Shennib et al. ..... 381/328
6,129,175 A * 10/2000 Tutor et al. ..... 181/135
6,368,288 B2 * 4/2002 Stone ..... 600/559
6,459,800 B1 10/2002 Brimhall
6,766,030 B1 7/2004 Chojar
7,206,328 B2 4/2007 Mochizuki
2002/0006209 A1 1/2002 Mahoney et al.
2007/0036379 A1 2/2007 Anderson et al.

FOREIGN PATENT DOCUMENTS

EP 2 026 605 A1 2/2009

* cited by examiner

*Primary Examiner* — Tuan Nguyen

(57) ABSTRACT

An earphone facility is proposed to reduce feedback in hearing devices with an external earphone. The earphone facility includes an earphone, which is embodied to convert electrical signals, and an earpiece, which lies snugly against the auditory canal when the earphone facility is being worn. A stem is attached to the earphone, having a smaller circumference than the smallest circumference of the earphone. Also a support element is disposed between the stem and an internal wall of the earpiece, said support element holding the stem in the earpiece in a movable manner. With this structure vibrations of the earphone are barely transmitted to the earpiece so that feedback is ultimately reduced.

12 Claims, 2 Drawing Sheets

EARPHONE FACILITY WITH VIBRATION-ISOLATED EARPHONE

CROSS REFERENCE TO RELATED APPLICATIONS

This application claims priority of German application No. 10 2008 049 929.9 filed Oct. 13, 2008, which is incorporated by reference herein in its entirety.

FIELD OF THE INVENTION

The present invention relates to an earphone facility for a hearing apparatus with an earphone, which is embodied to convert electrical signals, and an earpiece, which lies snugly against the auditory canal when the hearing apparatus is being worn. In particular the present invention relates to a hearing device to be worn behind the ear or in the cymba with such an earphone facility. A hearing device here refers to any acoustic device that can be worn on the head, in particular a hearing device, headset, headphones, and the like.

BACKGROUND OF THE INVENTION

Hearing devices are wearable hearing apparatuses serving to assist those with impaired hearing. To meet the numerous individual needs, different models of hearing devices are available, such as behind-the-ear hearing devices (BTE), hearing devices with an external earphone (RIC: receiver in the canal) and in-the-ear hearing devices (ITE), for example also concha hearing devices or canal hearing devices (ITE, CIC). The hearing devices listed by way of example are worn on the outer ear or in the auditory canal. However bone conduction hearing aids, implantable and vibrotactile hearing aids are also commercially available. With these the impaired hearing is stimulated either mechanically or electrically.

In principle the essential components of hearing devices comprise an input transducer, an amplifier and an output transducer. The input transducer is generally a sound receiver, e.g. a microphone, and/or an electromagnetic receiver, e.g. an induction coil. The output transducer is frequently in the form of an electroacoustic transducer, e.g. a miniature speaker, or an electromechanical transducer, e.g. a bone conduction earphone. The amplifier is generally integrated in a signal processing unit. This basic structure is shown in FIG. 1 based on the example of a behind-the-ear hearing device. One or more microphones 2 for receiving ambient sound are built into a hearing device housing 1 to be worn behind the ear. A signal processing unit 3, which is also integrated in the hearing device housing 1, processes the microphone signals and amplifies them. The output signal of the signal processing unit 3 is transmitted to a speaker or earphone 4, which outputs an acoustic signal. The sound is optionally transmitted to the eardrum of the device wearer by way of a sound tube, which is fixed in the auditory canal by means of an otoplastic. Energy is supplied to the hearing device and in particular to the signal processing unit 3 by a battery 5 which is also integrated in the hearing device housing 1.

The functionality of hearing devices is greatly impaired by feedback. Such feedback not only occurs with hearing devices in which the earphone and microphones are accommodated in one housing. Hearing devices with so-called external earphones (RIC) frequently also experience feedback due to a transmission of vibrations between the earphone and the housing of the main part of the device. The vibrations are then conducted to the corresponding microphone by way of the housing. It is possible for the vibrations to be transmitted in particular because of the rigidity of the cable or wire connecting the earphone to the main part of the hearing device. This problem is particularly acute with so-called cymba devices but also with other RIC devices, in which the wire holds the device in or on the auricle and therefore has to be designed to be correspondingly rigid.

Until now feedback problems were primarily resolved by signal processing measures (feedback cancelers). A mechanical solution is also known internally at least, according to which a microphone for example is adhered to the hearing device housing, so that the resonant frequency is displaced accordingly.

A flexible earpiece for a hearing aid is known from the publication US 2002/006209 A1, which can adjust to an auditory canal when worn. A spring is provided in the internal structure of the earpiece, to allow a high level of lateral and transverse yield.

An earpiece for a hearing aid, into which an earphone is inserted, is known from the publication EP 2 026 605 A1. The earphone is held by an elastic transition piece in a friction locked manner and thus supported in this in an elastic manner.

SUMMARY OF THE INVENTION

The object of the present invention is to improve the suppression of feedback for hearing apparatuses with an external earphone facility.

According to the invention this object is achieved by an earphone facility for a hearing apparatus with an earphone, which is embodied to convert electrical signals, and an earpiece, which lies snugly against the auditory canal when the earphone facility is being worn, with a stem attached to the earphone, which in relation to a common axis has a smaller circumference than the smallest circumference of the earphone, and with a support element disposed between the stem and an internal wall of the earpiece, said support element holding the stem in the earpiece in a movable manner.

The particular suspension of the earphone with the aid of the stem advantageously allows the damping support element to be configured with greater volume, so that vibrations of the earphone are transmitted to the earpiece to a lesser degree.

The earpiece is preferably embodied in the manner of a hollow cylinder and a support element in the form of a hollow cylinder is disposed in the interior of the earpiece, inside which the stem and earphone are supported. This allows the vibrations of the earphone to be damped effectively in practically all spatial directions.

In one embodiment the material of the support element is softer than the internal wall of a tubular base part, which supports the earpiece on the outside and the support element on the inside, and softer than the material of the stem. Foam for example can be one such soft support material.

In an alternative embodiment the support element has hairs or thread elements, the free ends of which bear the stem. Such thread elements and hairs prove particularly advantageous for damping vibrations.

A hollow base part can also be disposed inside the earpiece, inside which in turn the support element is disposed, so that said internal wall is formed by the base part. This base part has the advantage that a mechanically robust part is provided, which allows insertion of the earphone facility into the auditory canal without the risk of damage. A soft standard earpiece can then be attached outside of the harder base part to lie snugly against the auditory canal.

The stem preferably has a larger circumference at its free end than over the majority of its extension. The earphone including the stem can then also be fixed in its axial direction in the support element.

An electric line can also run through the stem to the terminal of the earphone. This prevents vibrations being transmitted for example directly from the earphone housing to the earpiece by way of an electric line. It is advantageous here if the above-mentioned base part holds a cable for supplying the earphone with an electrical signal and a wire, which is thinner than the cable and thinner than the stem, connects the cable to the earphone. This allows low frequencies of vibrations originating from the earphone in particular to be damped.

The length of the wire should also be much longer than the shortest distance between the wire and the stem. The wire is therefore not tensioned between the two contacts so that vibrations are transmitted to a lesser degree. It is advantageous here in particular if the wire is embodied in the manner of a helix.

The inventive earphone apparatus described above can advantageously be used in particular with hearing devices to be worn behind the ear or in the cymba.

BRIEF DESCRIPTION OF THE DRAWINGS

The present invention is described in more detail below with reference to the accompanying drawings, in which.

DETAILED DESCRIPTION OF THE INVENTION

The exemplary embodiments described in more detail below are preferred embodiments of the present invention.

Figure 1:
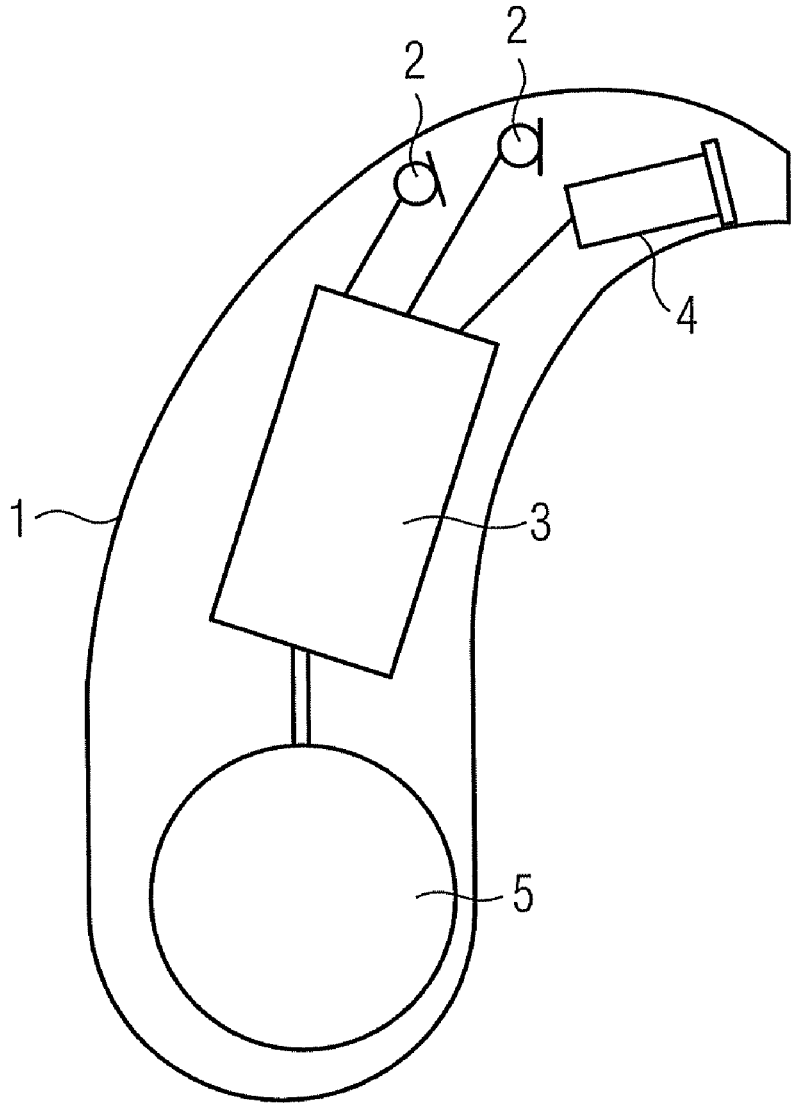
FIG 1 (Prior art)
FIG. 1 shows a schematic diagram of a hearing device according to the prior art.
Figure 2:
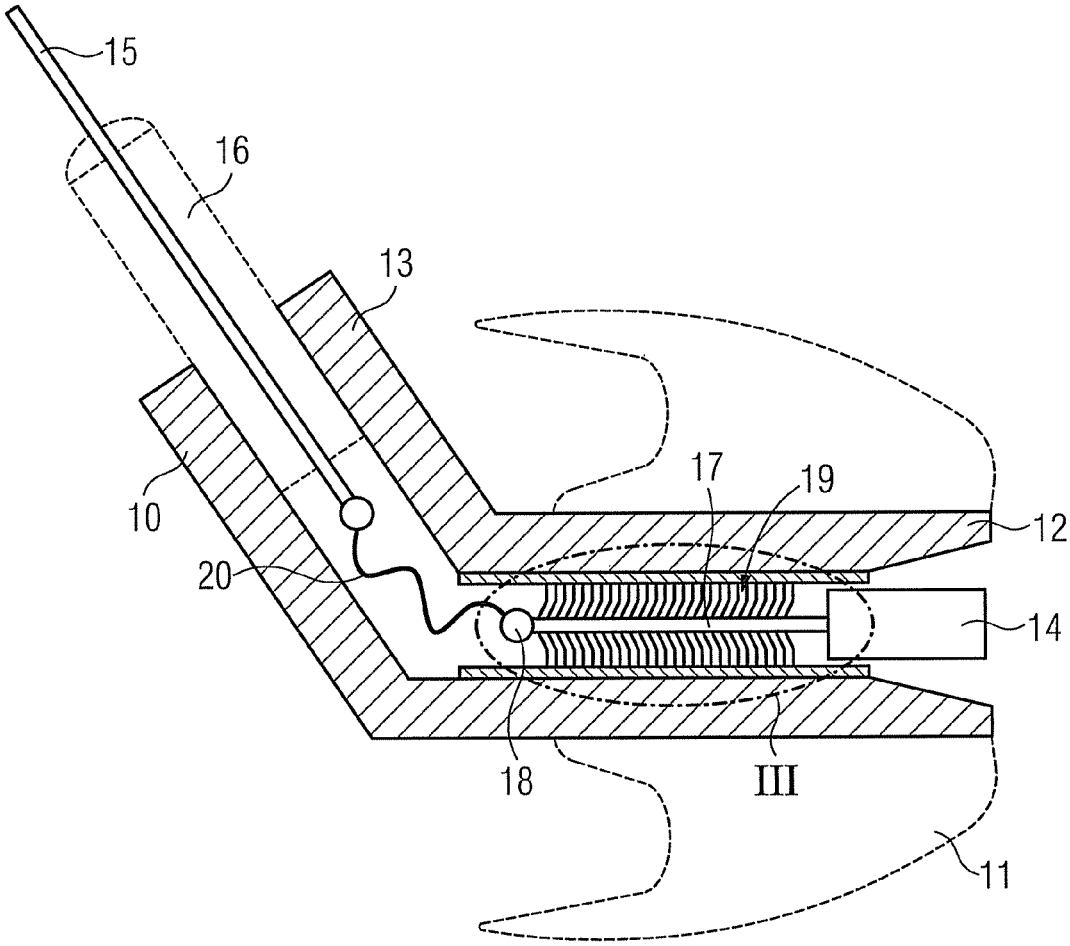
FIG. 2 shows a cross-section through an inventive earphone facility.

The earphone facility shown in FIG. 2 is typically used for BTE hearing devices with an external earphone and for cymba hearing devices. FIG. 2 only shows the earphone facility, i.e. the external earphone, not the hearing device itself with signal processor and microphone.

The diagram in FIG. 2 shows a base part 10, to which a standard earpiece 11 (dome) is attached. The base part 10 is made of a rather harder plastic, while the earpiece 11 is made of a soft, malleable material, so that the earpiece can lie snugly against the wall of the auditory canal when worn in the auditory canal. The base part 10 therefore has a support function in respect of the earpiece 11.

The base part 10 is embodied as angled or curved and has an internal section 12, which when worn is directed into the inside of the auditory canal, and an external section 13, which when worn projects outward out of the auditory canal and is directed toward the main part of the hearing device. The entire base part 10 is embodied as hollow. The internal section 12 of the base part 10 serves to accommodate an earphone 14. The external section 13 in contrast serves to accommodate or secure a cable, which leads to the main part of the hearing device and consists symbolically here of a conductor 15 and a plastic sheath 16. The cable is insulated to some degree inside the base part 1, so the end of the conductor 15 projects into the interior of the external section 13.

A stem 17 is attached securely to the earphone 14 on the side opposite the sound outlet. This stem 17 serves as the sole support for the earphone 14. It is embodied as rod-shaped and has a for example spherical thickening 18 at its free end.

The internal section 12 has a support element 19 inside, which serves as an elastic suspension for the earphone 14 or stem 17. The support element can be formed for example from a soft foam, which does not transmit the vibrations of the earphone 14 to the base part 10.

The support element 19 has a passage through its center, into which the stem 17 is inserted. The thickening 18 at the end of the stem 17 provides the stem 17 and earphone 14 with a certain hold in an axial direction of the stem 17, as the thickening 18 ensures greater resistance when the earphone 14 is withdrawn from the support element 19.

The earphone 14 is contacted electrically by way of the stem 17. To this end the stem 17 is either formed directly from an electrical conductor material or it is made for example of plastic and has a longitudinal through-hole, through which an electrical conductor is passed from the free end of the stem 17, i.e. from the thickening 18, to the earphone 14.

A thin, soft, conducting wire 20 is present for electrical signal transmission between the stem 17 or its end and the insulated end of the conductor 15 in the external section 13 of the base part 10. As shown clearly in FIG. 2, the wire 20 is not tensioned between the stem 17 and the conductor 15, but is wave-shaped. The material and form of the wire ensure that vibrations from the stem 17 are practically now barely transmitted to the conductor 15 of the connecting cable to the main part of the hearing device.

The structure shown in FIG. 2 thus allows mechanical insulation of the earphone 14 from the base part 10 and the connecting wire of the hearing device. To this end, as already indicated, the earphone 14 is suspended inside the base part 10 (earpiece support), in that the earphone stem 17 is inserted into a very soft material, which prevents the transmission of vibrations between the earphone 14 and the base part 10. The electrical connection between the earphone 14 and the electric line 15 is realized by the extremely thin wire 20. This wire 20 should be made of a highly conducting material (e.g. gold or silver). Its shape and material mean that it also contributes significantly to feedback reduction. It can be embodied in the manner of a spiral or helix in particular.

The structure shown in FIG. 2 has a particular damping function, as far as the conducting of vibrations from the earphone 14 by way of the cable 15, 16 to the actual hearing device is concerned. This is because not all frequencies are transmitted in an identical manner from the earphone 14 to the stem 17. Rather this tends to vibrate at higher frequencies than the earphone 14. The wire 20, which is embodied essentially thinner than the stem 17, will for its part mainly only transmit very high frequency components of the vibrations of the stem 17. The structure of the earphone facility according to the present invention therefore has a characteristic filter effect, which ensures that the resonances of the earphone 14 specifically are barely transmitted to the hearing device. The very thin wire 20 is protected by the base part 10 from external influences.

Figure 3:
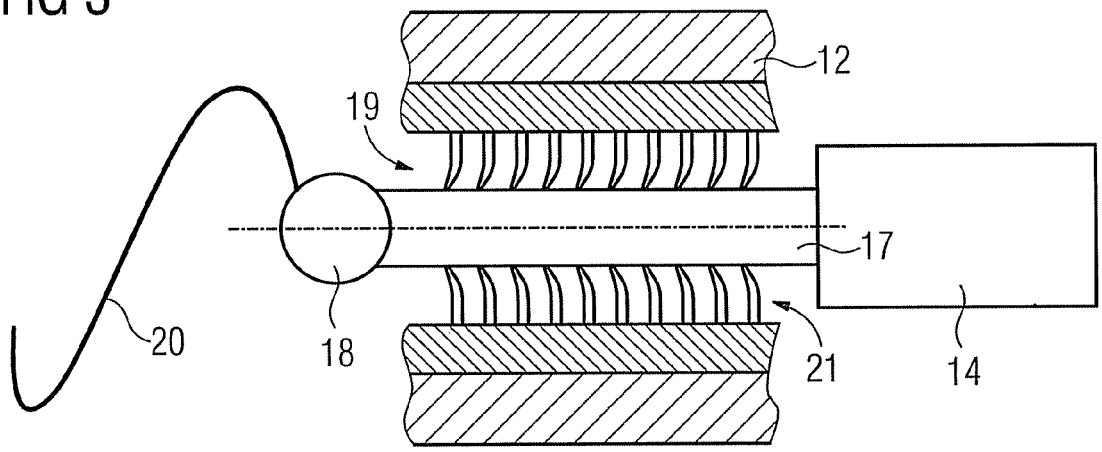
FIG. 3 shows an enlarged section from FIG. 2.

FIG. 3 shows an enlargement of the section marked DI in FIG. 2. It shows the earphone 14 with the stem 17 and thickening 18 and the thin wire 20 passed out therefrom. It is an important aspect of the exemplary embodiment shown here that the support element 19 has hairs or hair-type elements 21 inside the internal section 12 of the base part 10. These can also be threads or loops as in a carpet. The only important thing is that these hair-type elements 21 hold the stem 17 in an elastically sprung manner in the center of the internal section 12 due to their rigidity. The hair-type elements are extremely well suited to keeping the vibrations of the stem 17 away from the base part 10 or the internal section 12.

The stem 17 not only has a spectral filter effect due to its thinner configuration than the earphone 14. The stem 17, which has a smaller circumference than the earphone 14, can increase the material strength (in a radial direction in the examples in FIGS. 2 and 3) compared with instances where the support element has to support the earphone 14 directly, provided that the cutout in the internal section 12 remains the same. Otherwise, if the earphone 14 were to be borne directly with the same material strength as in the exemplary embodiments in FIGS. 2 and 3, the base part 10 would have to have a larger circumference accordingly. However this would diminish wearer comfort.

The particular advantage of the present invention, i.e. the physical separation of the electrical connection and mechanical connection from the earphone to the hearing device microphone is also clearly shown in the example in FIG. 3. The result of these measures is a better open-loop amplification and reduced feedback, thereby improving the functionality of the hearing device overall.

The invention claimed is:

1. An earphone device for a hearing apparatus, comprising:
an earphone;
an earpiece that lies against an auditory canal of a user of the hearing apparatus when the earphone device is being worn by the user;
a stem that is attached to the earphone and has a smaller circumference than a smallest circumference of the earphone in relation to a common axis; and
a support element that is disposed between the stem and an internal wall of the earpiece and holds the stem movably in the earpiece.

2. The earphone device as claimed in claim 1,
wherein the earpiece and the support element are hollow cylinders,
wherein the support element is disposed in an interior of the earpiece, and
wherein the stem and the earphone are supported inside the support element.

3. The earphone device as claimed in claim 1, wherein a material of the support element is softer than the internal wall of a tubular base part of the earpiece that supports the earpiece on an outside and supports the support element on an inside.

4. The earphone device as claimed in claim 3, wherein the material of the support element is softer than a material of the stem.

5. The earphone device as claimed in claim 1, wherein the support element comprises hairs or thread elements and free ends of the hairs or thread elements bear the stem.

6. The earphone device as claimed in claim 1, wherein the stem has a larger circumference at a free end than a circumference over an extension of the stem.

7. The earphone device as claimed in claim 1, wherein an electric line rims through the stem to a terminal of the earphone.

8. The earphone device as claimed in claim 1, wherein a base part of the earpiece holds a cable for supplying the earphone with an electrical signal and a wire that is thinner than the cable and thinner than the stem for connecting the cable to the earphone.

9. The earphone device as claimed in claim 8, wherein the length of the wire is longer than a shortest distance between the cable and the stem.

10. The earphone device as claimed in claim 8, wherein the wire is a helix.

11. A hearing device, comprising:
a housing;
a microphone arranged in the housing that receives an ambient sound;
a signal processing unit integrated in the housing that processes the microphone signal; and
an earphone device arranged in the housing that outputs the processed microphone signal,
wherein the earphone device comprises:
an earphone;
an earpiece that lies against an auditory canal of a user of the hearing apparatus when the earphone device is being worn by the user;
a stem that is attached to the earphone and has a smaller circumference than a smallest circumference of the earphone in relation to a common axis; and
a support element that is disposed between the stem and an internal wall of the earpiece and holds the stem movably in the earpiece.

12. The hearing device as claimed in claim 11, wherein the hearing device is to be worn behind an ear of a user or in a cymba of the user.

* * * * *